United States Patent [19]

Nagel

[11] 4,185,770

[45] Jan. 29, 1980

[54] AUTOMATIC FLUE DAMPER CONTROL SYSTEM

[75] Inventor: George W. Nagel, Forest Hills Boro, Pa.

[73] Assignee: Westinghouse Electric Corp., Pittsburgh, Pa.

[21] Appl. No.: 900,680

[22] Filed: Apr. 27, 1978

[51] Int. Cl.[2] ..... F23L 11/00

[52] U.S. Cl. ..... 236/1 G; 126/285 B; 318/762; 251/136

[58] Field of Search ..... 251/136, 133; 318/613, 318/160, 760, 762, 369; 236/1 G; 126/285 B; 431/20

[56] References Cited

U.S. PATENT DOCUMENTS

| | | | |
|---|---|---|---|
| 2,937,867 | 5/1960 | Schweig | 318/760 |
| 3,010,451 | 11/1961 | Hodgins | 126/285 B |
| 3,384,800 | 5/1968 | Norris et al. | 318/369 |
| 3,617,837 | 11/1971 | Beck | 318/762 |
| 3,798,523 | 3/1974 | Gross | 318/762 |

*Primary Examiner*—William E. Wayner
*Assistant Examiner*—Harry Tanner
*Attorney, Agent, or Firm*—E. C. Arenz

[57] ABSTRACT

For an automatic flue damper assembly of the type in which the motor of a clockwork mechanism is energized to hold the damper closed and the mechanism is mechanically biased to move the damper to an open position in the absence of motor energization, a stopping or braking arrangement is provided which applies DC to the motor for dynamic braking as the damper closely approaches its open position. Additionally, the remote possibility of a damper hang-up at an intermediate position resulting from a residual magnetic locking torque is substantially eliminated through the provision of an AC trickle circuit connected to the motor.

8 Claims, 6 Drawing Figures

FIG. 3
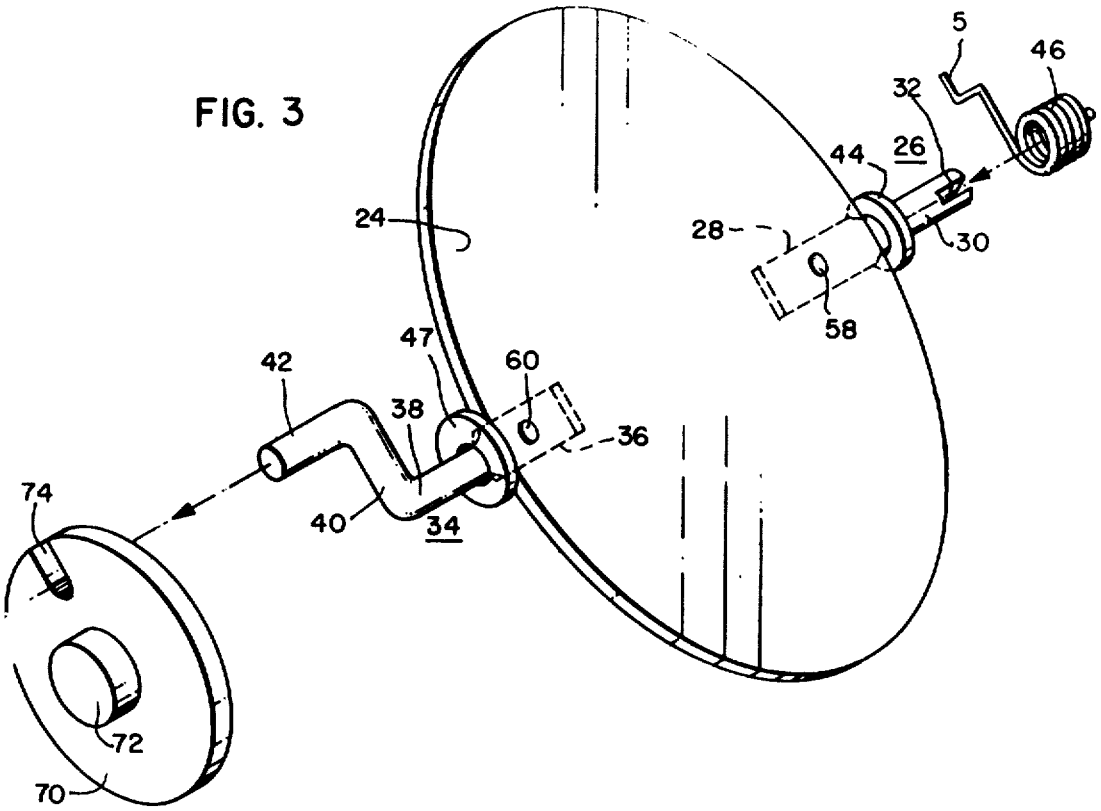
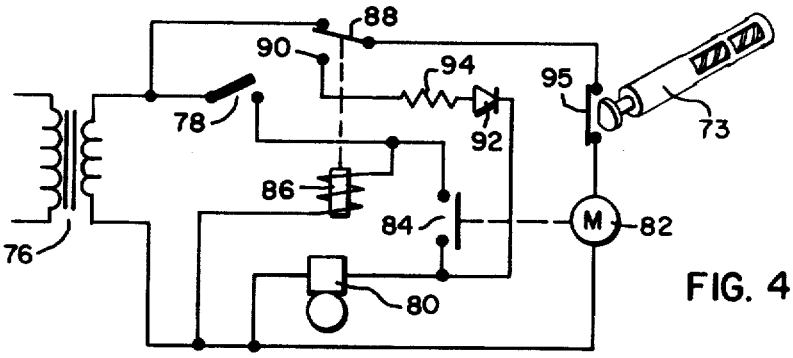
FIG. 4
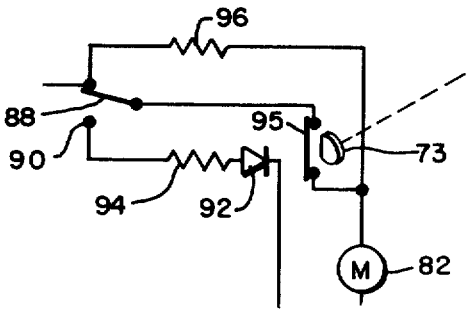
FIG. 5

AUTOMATIC FLUE DAMPER CONTROL SYSTEM

CROSS-REFERENCE TO RELATED APPLICATIONS

This application is one of several relating to a total damper assembly which in its totality is considered the preferred form.

The thus related applications include:

Dietsche-Nagel, U.S. Pat. application Ser. No. 900,683, filed Apr. 27, 1978, relating to an arrangement for biasing the damper to an open position in the absence of actuator means.

Dietsche-Schuster, U.S. Pat. application Ser. No. 900,682, Apr. 27, 1978, relating to a preferred damper shaft arrangement in which opposite stub shafts of a particular configuratiion are applicable to a range of damper sizes.

Nagel, U.S. Pat. application Ser. No. 900,681, filed Apr. 27, 1978, relating to a crank-shaped shaft end and slotted disk drive coupling assuring the proper coupling arrangement and providing an external visual indication of the internal damper position.

BACKGROUND OF THE INVENTION

The invention pertains to the art of electrically actuated vent or flue dampers useful for saving energy in furnaces such as those typically used domestically.

Some automatic flue dampers of which I am aware are actuated to their closed position by small synchronous electric motors suitably geared down so as to require 15 to 30 seconds to move the dampers from open to closed positions. Clockwork mechanisms are generally suitable and are therefore almost universally used. To assure the flue damper will always be open when a power failure exists, it is also customary for the operator mechanism to be biased toward the open position by a spring or springs strong enough to overcome the friction in the damper mechanism and in the clockwork actuator. This assures that whenever the driving motor is deenergized, whether by power failure or by normal switching, the damper will be returned to the open position.

It is apparent that a strain is put upon the speed reduction gearing of the mechanism each time that the motor drives the damper into the stop at the damper closed position. Fortunately, standard clockwork gearing is designed to survive this shock for hundreds of thousands of operations. However, the shock is significantly greater when the damper hits the stop in its open position. The reason for this is that since the return springs must be strong enough to overcome the static friction of the clockwork gear train with a reasonable margin of safety, it follows that during the damper opening cycle the speed of movement will be continually accelerated. In a typical mechanism, the speed of the clock motor and gears is 5 to 6 times normal when the damper reaches the full open position. This means that the energy stored in the rotor of the clock motor is 25 to 36 times as great as when it is normally powered on the closing stroke. When the mechanism encounters the stop at its full open position the strain on the gearing is so high that the service life of the device may be quite short; so short in fact that the mechanism may not be able to meet the standards of the regulatory agencies whose approval is required for most installations.

One way of solving the problem is to provide a relatively resilient stop with significant cushioning at the full open position to reduce the strain on the gearing at this point. In my view, this approach is not completely satisfactory since the open damper position needs to be rather well defined and this limits the resilience which can be tolerated.

Of course an obvious solution to the problem is to use nonstandard, extra-strength gearing in the clockwork mechanism. I do not favor this approach since it results in a significant increase in the cost of the mechanism with the attendant disadvantages to all concerned.

It is the aim of my invention to solve the problem by absorbing the stored energy of the clock motor rotor at the end of the damper opening stroke by electrical means without imposing any strain upon the gearing. It is also the aim of my invention that in absorbing the stored energy by the application of electrical means that the basic reliability of the system in the sense of the damper always opening when it is supposed to open is not impaired.

SUMMARY OF THE INVENTION

In accordance with the invention, a control system is provided for a furnace flue damper assembly of the type in which an AC damper motor is energized from an AC line to hold the damper in a closed position while the furnace is off, and biasing means drives the motor in a deenergized condition in a direction to move the damper to an open position when the furnace is to come on in response to a thermostatic demand for heat, with the system including electrically energized fuel flow means such as a solenoid operated gas valve, with the system including damper position responsive switch means actuated from an open to a closed position when the damper has moved in an opening direction to a position closely approaching full open, the damper position responsive switch means in a closed position effecting energization of the electrically energized fuel flow means so long as the thermostatic demand for heat exists, and with the system including means to disconnect the motor from directly across AC in response to closure of the thermostat, and to supply DC to the motor to dynamically brake the motor in response to the closed thermostat condition coupled with the closure of the damper position responsive switch.

In its most preferred form the system includes normally closed flue temperature responsive switch means with a trickle circuit connected between one side of the motor and one side of the AC line and in parallel with the last switch means to provide trickle AC for the motor when that switch means opens to eliminate the possibility of a residual magnetic locking torque in the motor preventing the rotation of the motor from an intermediate position to a full open position under certain conditions which are rarely encountered, but possible.

DESCRIPTION OF THE DRAWINGS

FIG. 3 is a partly fragmentary and exploded view of the coupling, shaft and damper arrangement;

FIG. 4 is a schematic view of the circuit arrangement;

FIG. 5 is a fragmentary circuit useful as an addition to the circuit of FIG. 4.

DESCRIPTION OF THE PREFERRED EMBODIMENT

The damper assembly as a whole, including the actuator means, is described in some detail in this application to ensure compliance with the statutory requirement of best mode currently contemplated by the inventor, as well as to provide a thorough understanding of how the particular features of the subject invention are advantageous in connection with the structure of the assembly as a whole, the circuitry and the operating characteristics of the particular type of actuator considered preferable. However, it is to be understood that as generally delineated in the section titled CROSS REFERENCE TO RELATED APPLICATIONS, other inventive entities have also contributed significantly to the assembly as a whole, and what is desired to be claimed in this application is only that which falls within the scope of the appended claims.

Figure 1:
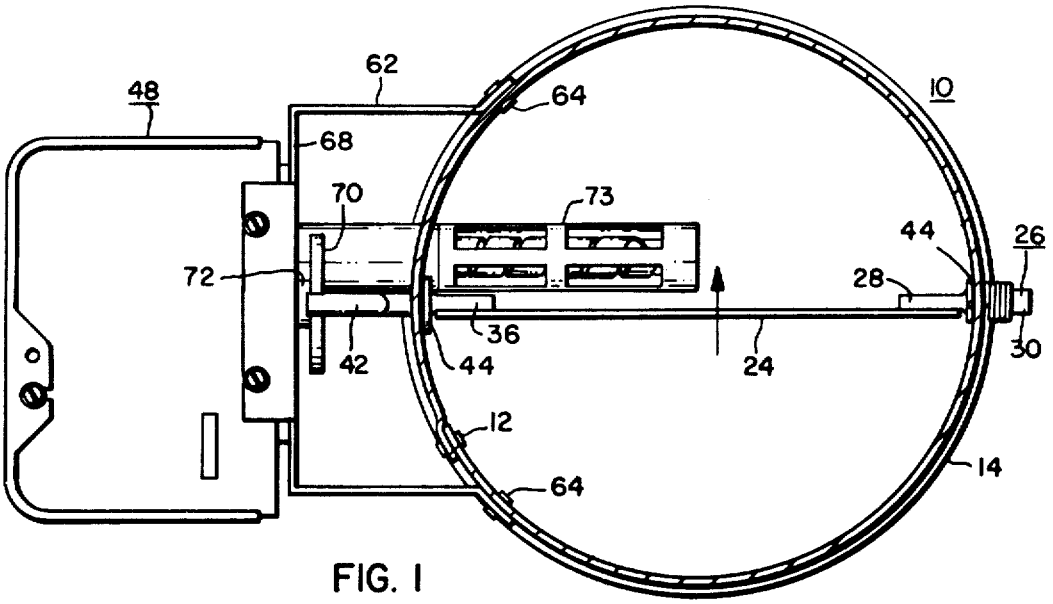
FIG. 1 is a plan view of the damper assembly.
Figure 2:
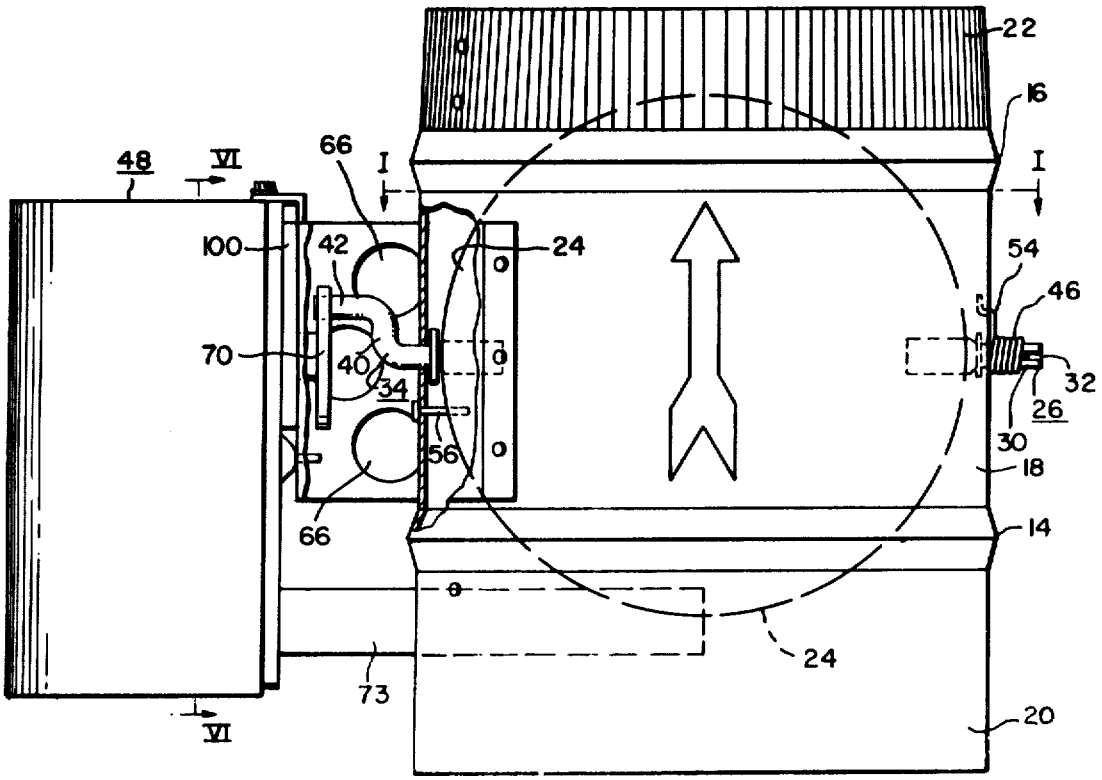
FIG. 2 is a partly broken side view of the damper assembly.

Referring to FIGS. 1 and 2, the assembled flue or vent pipe damper includes a pipe body 10 formed from a sheet of metal, such as 18 gauge aluminized steel, into a generally cylindrical shape and secured in that shape by a line of rivets 12 along the lap. Circumferentially extending beads 14 and 16 separate the central part 18 of the length from the inlet and outlet margins 20, 22, respectively. While not readily perceptible from the drawing, the pipe body is in fact slightly truncated so that the cross-sectional open area in the plane of the axis of the damper exceeds the cross-sectional area at the discharge end 22 by a sufficient amount such that, upon subtracting the obstruction of all parts in the damper axis plane (with the damper open), from the gross area in that plane, the unobstructed area equals or exceeds the area at the discharge end. By virtue of the pipe body being rolled into shape from relatively inexpensive material, the pipe body may be made sufficiently long or high that upon insertion of sheet metal screws through the lapping inlet and outlet pipes at the marginal ends, the space through which the damper plate moves is sufficiently spaced from the sheet metal screws that accidental obstruction of damper plate movement is avoided.

The damper plate 24 is a flat circular disk of a material such as aluminized steel and has a total area sufficiently less than the cross-sectional area of the plane at the damper axis as to meet the regulatory standards regarding percentage of obstruction with the damper in a closed position. The damper plate is shown in its open position in both FIGS. 1 and 2 and is rotatable toward a closed position in a direction which, as viewed in FIG. 2, would have the top edge of the damper moving away from the viewer. To support the damper plate for its pivotal movement, two discrete stub shafts are secured to one face of the plate adjacent diametrically opposite edges of the plate and are journaled in openings at opposite sides of the pipe body. Referring to FIG. 3 as well as FIGS. 1 and 2, the shaft means includes the right-hand stub shaft 26 which has a flattened portion 28 and a straight round shaft portion 30 provided with a longitudinally extending slot 32 which lies at 90° relative to the plane of the flat. The left-hand stub shaft 34 also has a flattened portion 36 and a round shaft end portion 38 formed into a crank shape including a lever arm portion 40 and a pin portion 42 whose axis is offset from the axis of the shaft means. Each round portion of each stub shaft also carries a washer 44 slipped on and located closely adjacent the transition or beginning part of the flats.

A coiled torsion spring 46 (FIGS. 1-3) cooperates with the right-hand stub shaft 26 in the final assembly to bias the damer plate 24 to an open position in the absence of the actuator means 48 (FIGS. 1 and 2) which normally controls damper positioning. The spring has one end tine 50 which is received into slot 32, and an opposite end hook 52 which is received into a hole 54 in the pipe body at a location spaced from the axis of the shaft means. The spring is designed so that the opening force it exerts is relatively light as compared to the force imposed by the actuator means 48 in both its damper closing and opening modes. The opening force of the torsion spring need only be sufficient to overcome any frictional resistance in the damper assembly with the actuator removed. While the torsion spring force aids the force of the actuator in the damper opening mode, it opposes it in the damper closing mode which, in the currently preferred assembly, is accomplished by an electric motor drive. To limit the movement of the damper blade to the full open position when the actuator means is removed, a rivet pin 56 (FIG. 2) is fixed below the shaft means at the one side of the pipe body.

The way in which the parts of the damper assembly thus far described are assembled is as follows:

The damper plate 24 is first spot welded or otherwise secured as at 58 to the flat 28 of the stub shaft 26, the washer 44 is slipped onto the shaft and the round straight part 30 of the shaft is inserted through the journaling hole of the pipe with the washer on the inside of the pipe. The torsion spring 46, which has been located with its hooked end 52 in place when the shaft was pushed through the pipe hole, is manipulated by winding it up slightly to locate the tine 50 in the slot 32. Then the opposite stub shaft 38 with its washer 44 in place has its crank end portion snaked through the opposite journaling opening in the pipe body from the inside of the pipe. The plate 24 is turned down against the torsion spring and a fixture (not shown) abuts the bottom face of the plate and positions the plate for the second spot weld or other securement at the location 60. The stub shaft 38 is of course angularly disposed so that the flat 36 is aligned with the flat 28 of the other stub shaft, and the crank-shaped end is properly directed for the ultimate coupling with the actuator means. Before the welding occurs the stub shafts are moved in opposite outward directions to almost snug up the transition parts of the flats against the washers 44, allowing about 1/16 to ⅛inch (1.6 to 3.2 $\times 10^{-3}$m) slop in the total assembly to avoid any binding problem. The washers 44 facilitate the positioning of the parts and prevent lateral shifting of the damper plate assembly to a point that binding would occur since the holes in the washers each lie in a plane whereas the journaling holes in the pipe body are not each in a plane.

To mount the actuator means 48 (FIGS. 1 and 2), a generally U-shaped bracket 62 is secured by riveting as at 64 along the marginal edge portions of the legs of the bracket to the intermediate section 18 of the pipe body at that side of the pipe body through which the crank-shaped end of the shaft means projects. It is noted that three openings 66 are provided in each of the opposite legs (only those in the far leg being shown in FIG. 2) to promote ventilation through the bracket regardless of the horizontal or vertical disposition of the pipe body 10 to reduce any likelihood of overheating of the actuator means 48 from the hot pipe body. The bight 68 of the bracket 62 includes a centered hole (not shown) which is large enough to readily pass the rotatable disk 70 which is fixed on the output shaft 72 of the reduction gear train of the actuator, and which in turn is driven by a synchronous clockwork motor.

The actuator frame supports, in cantilever fashion, a flue temperature responsive element 73 (FIGS. 1 and 2) which includes a helical bimetal of the type commonly used for overheat limit purposes in conventional furnace control systems. As will be explained additionally in connection with FIGS. 4–6, this element is effective to cause opening of a normally closed switch if the flue temperature rises above a given temperature. The intended result of opening the switch is to cause the flue damper to operate to an open position or, if already open, to maintain the damper open until the flue temperature drops below the set value. Thus, opening of the flue temperature responsive switch can indicate a stoppage of adequate flow of hot flue gases. An open switch can also function to delay the closure of the damper for a sufficient time after the termination of a normal period of furnace operation to permit the combustion products still in the furnace to escape up the flue, as well as preventing damper closure after the room thermostat has opened if through any malfunction the furnace fuel supply does not shut off.

The coupling of the actuator means to the plate and pipe assembly is accomplished by the pin portion 42 (FIG. 3) of the crank end of the stub shaft 34 being received in the radial slot 74 of the disk 70. The width of the slot is slightly greater than the diameter of the pin 42 to facilitate the assembly and it is considered preferable that the slot extend to the periphery of the disk and may also be flared thereat to further facilitate assembly. The axis of the output shaft 72 and the damper plate shaft means are of course aligned in the assembly.

The actuator means 48 is of the type in which an electric motor, when energized, rotates the damper plate from open to closed and holds the damper closed so long as energization continues. Upon deenergization of the motor, biasing means built in the actuator means mechanically drives the motor reversely and causes the damper plate to be moved to an open position. As noted before, it is the use of relatively strong biasing means to drive the motor reversely which creates the problem of gear train strain to which one aspect of this invention is directed.

The schematic circuit of FIG. 4 for controlling the movement of the damper includes transformer 76 to obtain the usual 24 volts AC in the secondary, a room thermostat 78 which operates from open to closed in response to a demand for heat, a fuel controlling device such as a solenoid controlled gas valve 80 as shown (or an oil pump motor for an oil burner, for example), the damper motor 82 which drives the damper plate shaft means through a gear train, a damper position responsive switch 84, and relay means including actuating means such as coil 86 and controlled switch means 88. The parts of the circuit thus far described are conventional with the switch 88 in the conventional circuit being a single-pole, single-throw switch which is either open or closed under the control of the coil 86.

However, in accordance with this invention, in the currently preferred circuit the switch 88 is a single-pole, double-throw switch which functions, when the switch closes to terminal 90 (which in the conventional circuit would be the switch-open position), to connect a motor braking circuit including a rectifier, such as diode 92, and a resistor 94 connected in series to obtain direct-current dynamic braking. The common terminal of switch 88 is connected throught the normally closed switch 95, controlled by the flue temperature responsive element 73, to the one side of the damper motor 82. Whenever the switch 95 is open for any reason the damper motor is disconnected from across full AC, and the biasing means urges the damper toward a full open position.

The bare concept of direct-current dynamic braking of alternating current motors is not new since it has been applied in connection with relatively large industrial motors for some time so far as I know. An example of its application would be to quickly stop a large saw or other machine for safety or other reasons. One explanation of DC dynamic braking may be found, for example, in the text "Magnetic Control of Industrial Motors," published in 1961 by John Wiley and Sons, Inc. in which in Part 2 , "Alternating Current Motor Controllers," page 43, where it is stated:

> "If the stator of an induction motor is excited with direct current, a d-c flux is set up in the motor, which is stationary in space. When the motor is driven by a load, the rotor conductors intersect the d-c flux. An emf is generated in the rotor conductors, causing current to flow in the rotor conductors. This current in conjunction with the d-c flux, develops torque which is opposed to the torque driving the motor."

As shown in FIG. 4, the circuit is in a condition in which the furnace is off, the thermostat 78 is open, the switch 88 is closed to energize motor 82 (which holds the damper plate closed), and of course the gas valve 80 is shut. Upon a demand for heat sensed by the thermostat, it closes and energizes relay coil 86 which opens switch 88 in the conventional circuit (and closes the switch to terminal 90 in the preferred circuit). In either case, the motor 82 is deenergized and the biasing means will drive the motor in the reverse direction and move the damper plate to the open position. As the damper plate closely approaches the full open position, the switch 84 closes and this results in energization of the solenoid controlling the gas valve 80 to permit the flow of gas to the burners. In the conventional arrangement the reverse direction of the motor is stopped mechanically, while in my arrangement the operation of switch 84 results in the application of DC to the motor through terminal 90 and switch 88. The application of DC dynamically brakes the motor so that the gearing is not subject to heavy strain. The resistor 94 is provided to limit motor heating and reduce stress on the diode 92, since the rectifier or braking circuit of course remains connected so long as the switch 84 is closed and the switch 88 is in the terminal 90 position corresponding to the damper being open and the furnace operating. A resistance value in the range of 20 to 50 ohms will perform quite satisfactorily with a 24 volt typical clock motor.

It is noted that the interlock switch 84, which requires the damper to be open to energize the gas valve solenoid, is a functional requirement in a conventional circuit. I take advantage of this arrangement by connecting the braking circuit between the switch 84 and gas valve solenoid. Thus the normal design requirement that the interlock switch be actuated before the damper stops has been met, and the motor rotor and damper are stopped almost immediately after closure of the switch.

When the thermostat 78 opens in response to the satisfaction of the demand for heat, the relay coil 86 is deenergized so that switch 88 operates to a position energizing the damper motor 82 directly across AC to drive the damper against the biasing means to a closed position. It will be appreciated that the damper position responsive switch 84 opens almost immediately as the damper begins to move from its full open position, and of course the braking circuit is disconnected as soon as the thermostat opens.

AC TRICKLE CIRCUIT

An additional circuit herein characterized as an AC trickle circuit is also considered to be a preferred addition to the basic circuit of FIG. 4 because of a phenomenon associated with the DC braking. While applying DC to the windings of an AC induction type of electric motor will provide dynamic braking torque, it will provide static torque as well if the motor is of the synchronous hysteresis type (as is commonly used to drive clockwork mechanisms of the type herein involved) .Even after the removal of the DC, the hysteresis effect will still provide a small locking torque which will resist an external torque which may be applied to rotate the deenergized motor. While the likelihood of an unsafe condition arising from this with the described assembly is remote, over the life of the assembly the actuator may be operated well over 100,000 times and each operation increases the chance of a failure of one part or another. If there is a failure of the damper responsive switch 84 is a closed position, it is then possible that the full braking torque will be applied to the motor when the damper is not in its fully open position, and when the braking torque is subsequently released the residual locking torque may be great enough that the damper will not restart to open under the influence of the biasing means provided.

Thus, in accordance with another aspect of my invention a small amount of AC power is applied to a residually "locked" motor to quickly demagnetize it to the extent that the locking torque is effectively eliminated. The driving torque which this small amount of AC power provides can be negligible compared to the normal motor torque or to the torque provided by the biasing means.

The way in which the trickle circuit works in conjunction with the remainder of the circuit is perhaps best understood by first explaining certain possible failures and the safety considerations involved. One contingency against which the user must be protected is that of having the furnace in continued operation with the damper closed. The damper may fail to open for a number of mechanical reasons, such as dented or warped flue pipe jamming the damper plate, pivots rusted or stuck by foreign material, motor gear train developing high friction or breaking, the actuating mechanism coming loose from the pipe, a jam of the coupling between the actuator and damper, etc. The damper position responsive switch 84 is provided as a "watcher" to prevent dangerous conditions with respect to the damper position. If that switch is functioning correctly, it will prevent furnace operation because it will not be closed with the damper being in other than a full open position. A resulting cold house will be a signal to the user that repair is needed and the furnace as a whole will have failed in a safe condition in that it will not operate. But it is possible that switch 84 may fail by sticking in a closed position (which others have calculated to be anticipated about four times per million operations). This condition does not signal the user that repair is necessary.

In this case with a demand for heat the furnace now comes on immediately when the room thermostat 78 closes. The damper cannot open (although the damper motor is disconnected from AC) since the DC brake is immediately applied. At this point the flue temperature responsive switch 95 comes into play. As soon as the flue heats up to the switch 95 set point the switch 95 opens and releases the DC brake. Normally the damper should now open under the force of the biasing means and it will unless the DC residual locking torque hangs it up. It is to be expected that in all instances where the damper is in a fully closed position when this occurs, the force of the biasing means under that condition is adequate to overcome the residual locking torque. However, when the damper is in a partly closed position (as can occur with the room thermostat 78 being set up or closing for any other reason very shortly after the flue temperature switch has closed so that the damper has just begun its closing movement), the lesser force of the biasing means in that damper position may be inadequate to overcome the residual locking torque when the dynamic brake is released with the opening of the flue temperature responsive switch 95. In this failure mode, the furnace can continue to run with the damper partly closed and the user is not signaled for the need of repairs since the heat he desires is available from the operating furnace. It is to solve this possible safety problem that the AC trickle circuit invention is directed.

As shown in FIG. 5, the AC trickle circuit comprises a resistor 96 which is connected between one side of the motor 82 and one side of the AC line and in parallel with the flue temperature responsive switch 95 to provide a trickle or reduced AC current anytime when the flue temperature responsive switch 95 is open. For a typical 24volt clock motor the resistor is preferably in the range of about 200 to 1,000 ohms. Since the circuit is in parallel with the normally closed flue temperature responsive switch 95, in normal operation of the furnace, the trickle circuit has no effect upon the control operation. It is only in those rarely expected cases in which there is a combination of the damper position responsive switch 84 failing shut, and the furnace restarting when the damper motor has cranked the damper only part of the way toward closed that it is expected that the trickle circuit will have to function in its intended manner.

Figure 6:
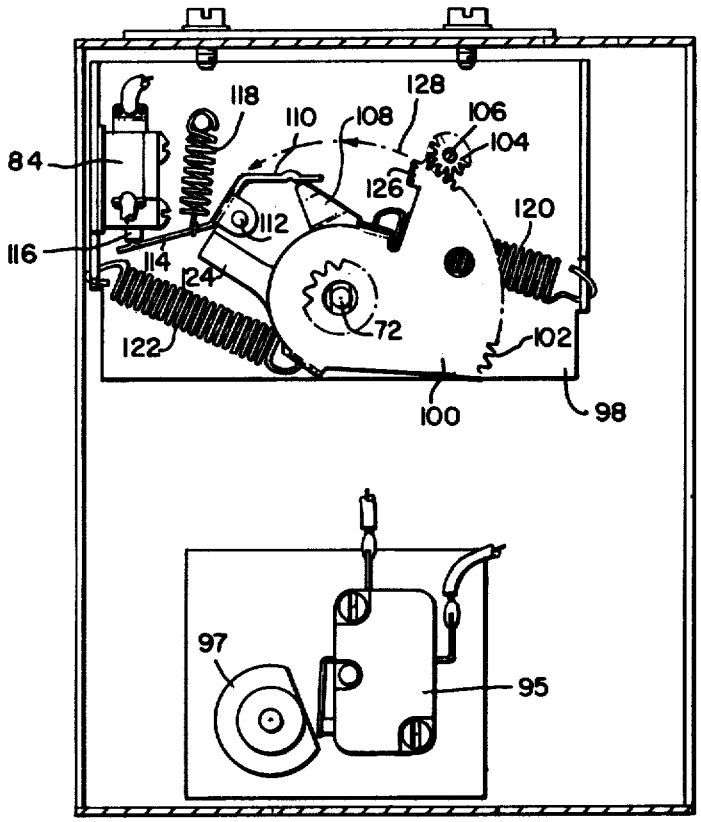
FIG. 6 is a cross section corresponding to one taken along the line VI—VI of FIG. 2.

FIG. 6 illustrates the general arrangement of and relation between the gearing, the drive from the motor 82, the biasing means, and the damper position responsive switch means 84. The overall design of the actuator means shown is in large part contributed by others. The output shaft 72 of the actuator means is journaled in the plate 98 and pivotally mounts the sector gear 100 which has gear teeth along the arc 102. These teeth mesh with the teeth of spur gear 104 driven by the output shaft 106 of the clockwork motor 82 (not shown in FIG. 6). The arrangement as shown is in the condition which it assumes shortly after the closure of the room thermostat switch 78 (FIG. 4) and before the temperature of the flue gases has risen enough to cause opening of the flue temperature responsive switch 95, and corresponding to the damper being fully open, switch 84 in a closed position, and the dynamic brake being on through the application of DC to the motor. The closure of the switch 84 occurs when the cam 108 fixed to the sector gear rocks the lever 110 in a counterclockwise direction about the pivot pin 112 to move the remote end 114 away from the switch buttom 116 and against the pull of the spring 118 biasing the lever in a switch-open direction. The main biasing means for the arrangement shown comprises two tension springs 120 and 122 which urge the sector gear 100 in a clockwise direction which drives the clockwork motor in a reverse direction. While the gear 100 carries a backup stop 124 positioned to engage the pin 112 if for any reason the dynamic braking should fail, in the intended operation the dynamic braking stops the motor rotor rotation within a fraction of a second of closure of switch 84 and stop 124 does not funcion by mechanically abutting the pin.

When the room thermostat 78 (FIG. 4) is satisfied and opens, the motor 82 will be energized as explained heretofore and drive the sector gear 100 in a counterclockwise direction against the biasing springs until the damper closes with the motor stopping when the abutment 126 on the sector gear has swung through the dashline arc 128 and is stopped by the lever 110. The motor remains energized to hold the damper in a closed position. It will be understood that the arrangement of a mechanical bias in the damper open direction provides one aspect of fail-safe operation in the event of an electrical failure in the damper circuit. It also results in the actuator means automatically being in a damper open position during the assembly of the actuator means to the rest of the damper assembly, and this fortuitously corresponds to the position that the damper plate takes because of the torsion spring 46 so that the correct assembly is facilitated. There is no chance that the coupling between the disks 70 and pin 42 can be at other than the correct angular relationship.

What is claimed is:

1. A control system for a furnace flue damper assembly of the type in which an AC damper motor energized from an AC line holds the damper in a closed position while the furnace is off, and biasing means drives the motor in a deenergized condition in a direction to move the damper to an open position when the furnace is to come on in response to a thermostatic demand for heat, comprising:

electrically energized fuel flow means;

damper position responsive switch means actuated from an open to a closed position when said damper has moved in an opening direction to a position closely approaching full open, said damper position responsive switch means in a closed position effecting energization of said electrically energized fuel flow means so long as the thermostatic demand for heat exists;

means to disconnect said motor from directly across AC in response to closure of said thermostat, and to supply DC to said motor to dynamically brake said motor in response to said closed thermostat condition coupled with closure of said damper position responsive switch.

2. A control system according to claim 1 including:

normally closed switch means responsive to a flue temperature above a given value to open to disconnect said motor from directly across AC and from the supply of DC.

3. A system according to claim 2 including:

means to provide a trickle of AC current to said motor, when said flue temperature responsive switch means opens, to demagnetize said motor to the extent that any residual locking torque from the dynamic braking is effectively eliminated.

4. A system according to claim 3 wherein:

said AC trickle current providing means includes a resistor connected between one side of said AC line and said motor and in parallel with said flue temperature responsive switch means.

5. A control system for a furnace flue damper assembly of the type in which an AC damper motor energized from an AC line holds the damper in a closed position while the furnace is off, and biasing means drives the motor in a deenergized condition in a direction to move the damper to an open position when the furnace is to come on in response to a thermostatic demand for heat, comprising:

a thermostatic switch for controlling furnace operation;

electrically energized flow means;

relay means including actuating means and controlled switch means, said controlled switch means having first and second positions corresponding to said relay actuating means being energized and deenergized, respectively;

a damper position responsive switch operable from open to closed when said damper has moved in an opening direction to closely approach a full open position;

a thermostatic switch controlled circuit connected across said line including said thermostatic switch in series with one branch circuit including said electrically energized fuel flow means and said damper position responsive switch in series, and in series with another branch circuit including said relay actuating means in parallel with said one branch circuit;

a first, full AC, motor energization control circuit connected in parallel with said thermostatic switch controlled circuit and across the line, said first circuit including said relay controlled switch means in said second position and said motor in series for energizing said motor at full AC; and a second, braking circuit including in series a rectifier, said relay controlled switch means in said first position and said motor, said second, braking circuit being connected across AC concurrently with closure of said damper position responsive switch to effect a DC supply to said motor to dynamically brake said motor at said close approach of said damper to a full open position.

6. A control system according to claim 5 including:

normally closed flue temperature responsive switch means in series with said motor and operable to an open position to disconnect both said first control circuit and said second, braking circuit in response to a flue temperature in excess of a given value.

7. A control system according to claim 5 wherein:

said second, braking circuit is connected at its end opposite said motor to said thermostatic switch controlled circuit at a point between said damper position responsive switch and said electrically energized fuel flow means.

8. A control system according to claim 6 including:

an AC trickle circuit including a resistor connected between one side of said AC line and said motor and in parallel with said flue temperature responsive switch means.

* * * * *